US005903095A

United States Patent [19]

Yoshida et al.

[11] Patent Number: 5,903,095

[45] Date of Patent: May 11, 1999

[54] APERTURE TYPE FLUORESCENT LAMP

[75] Inventors: Mitsunari Yoshida; Tomonori Abe, both of Kanagawa-ken; Toshiyuki Terada, Tokyo; Kazuaki Kawasaki, Kanagawa-ken, all of Japan

[73] Assignee: Stanley Electric Co., Ltd., Tokyo, Japan

[21] Appl. No.: 08/928,835

[22] Filed: Sep. 12, 1997

[30] Foreign Application Priority Data

Mar. 7, 1997 [JP] Japan ..... 9-053401

[51] Int. Cl.[6] ..... H01J 61/00

[52] U.S. Cl. ..... 313/485; 313/493; 313/573; 313/607; 313/234; 313/635

[58] Field of Search ..... 313/493, 572, 313/573, 607, 594, 234, 635, 485

[56] References Cited

U.S. PATENT DOCUMENTS 4,887,002 12/1989 Dobashi et al. ..... 313/607

5,256,935 10/1993 Dobashi et al. ..... 313/594 X 5,514,934 5/1996 Matsumoto et al. ..... 313/234 X

*Primary Examiner*—Ashok Patel

*Attorney, Agent, or Firm*—Weingarten, Schurgin, Gagnebin & Hayes LLP

[57] ABSTRACT

There is provided an aperture type fluorescent lamp comprising a tubular bulb, an electrode, and a fluorescent layer formed on an inner surface of said tubular bulb in an axial direction of the tubular bulb, an aperture portion provided in said fluorescent layer along the axial direction of the tubular bulb so as to be made the aperture portion as a radiation portion, wherein said aperture portion comprises an aperture portion fluorescent layer having a thickness smaller than the fluorescent layer of other portions. The fluorescent lamp according to the present invention makes it possible to eliminate nonuniformitiy in illuminance.

5 Claims, 2 Drawing Sheets

APERTURE TYPE FLUORESCENT LAMP

BACKGROUND OF THE INVENTION

1. Field of the Invention

This invention relates to a fluorescent lamp and, more specifically, to a fluorescent lamp in which an aperture portion is formed in a fluorescent layer along an axial direction of a tubular bulb so that light from the fluorescent lamp is radiated concentrically in one direction, for example, to be used as a reading light source for facsimiles.

2. Background Art

FIGS. 5 to 7 show the configuration of this type of aperture type fluorescent lamp of the prior art. FIG. 5 shows an aperture type fluorescent lamp 90 configured such that a thermo-electrode or cold cathode is provided at both ends of a tubular bulb 91. In this case, an aperture portion 95 is generally formed in a fluorescent layer 94 formed on an inner surface of the tubular bulb 91 by coating the entire inner surface thereof with the fluorescent layer and removing a part of the fluorescent layer 94 in an axial direction of the tubular bulb 91.

With this configuration, light directing toward the inside of the tubular bulb 91 out of light emitted from the fluorescent layer 94 is radiated outward from the aperture portion 95 which lets light passing therethrough directly. Thereby, the aperture portion 95 is brighter than other portions, and the aperture portion 95 is turned toward a direction to be illuminated.

FIG. 6 shows an example of an aperture type fluorescent lamp 80 configured such that lighting is carried out by a pair of external electrodes 82, 83 provided on the outer surface of the tubular bulb 81 and facing each other. Also in this case, an aperture portion 85 is formed in the fluorescent layer 84 formed on the inner surface of the tubular bulb 81 by the same manufacturing manner as described above, and the same function as that of the prior art described above is obtained.

In the case of this aperture type fluorescent lamp 80, the external electrodes 82, 83 are formed by aluminum vapor deposition or silver conductive coating to have a reflection function, thereby making it possible to reflect light going to the outside of the tubular bulb 81 out of light emitted from the fluorescent layer 84 toward the inside and radiate it from the aperture portion 85. Thus, efficiency can be improved.

Further, FIG. 7 shows an example of an aperture type fluorescent lamp 70 configured such that lighting is carried out by an internal electrode 72 provided at the center in an axial direction of a tubular bulb 71 and an external electrode 73 provided on the outer surface of the tubular bulb 71. Also in this case, an aperture portion 75 is formed in a fluorescent layer 74 formed on the inner surface of the tubular bulb 71 by the same manufacturing manner as described above and the same function as described above is obtained.

However, in the aperture type fluorescent lamps 70, 80, 90 of the prior art described above, the aperture portions 75, 85, 95 are simply formed in the fluorescent layers 74, 84, 94 formed on the inner surfaces of the tubular bulbs 71, 81, 91, respectively. If a reflection function is given to the outer surface of the tubular bulb, the shape of means having such a reflection function is limited to the shape of the outer surface of the tubular bulb 71. Therefore, desired distribution characteristics cannot be provided to light radiated from the aperture portions 75, 85, 95, resulting in nonuniform illuminance.

Particularly, in the aperture type fluorescent lamp 70 having the internal electrode 72 shown in FIG. 7, as the internal electrode 72 shades the emitted light, the above nonuniform illuminance becomes more significant and the internal electrode 72 can be seen from the aperture portion 75 directly, thereby giving an observer a feeling of disorder.

SUMMARY OF THE INVENTION

An object of the present invention for solving the above problems of the prior art is to provide an aperture type fluorescent lamp comprising a tubular bulb, an electrode, and a fluorescent layer formed on an inner surface of the tubular bulb in an axial direction of the tubular bulb, an aperture portion provided in said fluorescent layer along the axial direction of the tubular bulb so as to be made the aperture portion as a radiation portion, wherein the aperture portion comprises an aperture portion fluorescent layer having a thickness smaller than the fluorescent layer of other portions.

Another object of the present invention is to provide an aperture type fluorescent lamp as above, in which the electrode comprises a thermo-electrode provided at both ends of the tubular bulb.

A further object of the present invention is to provide an aperture type fluorescent lamp as above, in which the electrode comprises a cold cathode provided at both ends of the tubular bulb.

A still further object of the present invention is to provide an aperture type fluorescent lamp as above in which the electrode comprises a pair of external electrodes provided on an outer surface of the tubular bulb and facing each other.

A further object of the present invention is to provide an aperture type fluorescent lamp as above in which the electrode comprises an internal electrode provided at the center in the axial direction of the tubular bulb and an external electrode provided on an outer surface of the tubular bulb.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
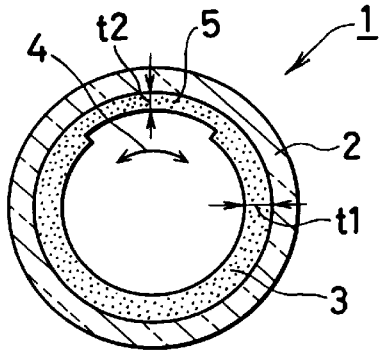
FIG. 1 is a sectional view of an aperture type fluorescent lamp according to a first embodiment of the present invention.

The present invention is described in detail hereinafter with reference to embodiments shown in the accompanying drawings. FIG. 1 shows a first embodiment of the present invention. This first embodiment is an aperture type fluorescent lamp 1 comprising a tubular bulb 2 and electrodes (not shown) provided at both ends in an axial direction of the tubular bulb 2.

Also in the present invention, a fluorescent layer 3 is formed on an inner surface of the tubular bulb 2 and an aperture portion 4 is formed in the fluorescent layer 3 along the axial direction of the tubular bulb 2 like the prior art. However, in the present invention, an aperture portion fluorescent layer 5 having a thickness t2 smaller than the thickness t1 of the fluorescent layer 3 is formed on the aperture portion 4.

Describing the general properties of the fluorescent layer, since the fluorescent layer comprises fine particles of a fluorescent material, a binder and the like, it has the function of emitting visible light by ultraviolet light and appropriate light transmission and diffusion properties. There exists the optimal film thickness for obtaining the maximum amount of light.

When the film thickness of the fluorescent layer is reduced, the amount of light emitted therefrom decreases but the light transmission property thereof increases and the function thereof as a diffusion sheet becomes significant. However, as the function thereof as a diffusion sheet lowers when the film thickness is reduced too much, the optimal film thickness exists when the fluorescent layer is caused to serve as a diffusion sheet. Therefore, the film thickness t1 of the fluorescent layer 3 is set as the optimal film thickness for obtaining the maximum amount of light emitted therefrom and the film thickness t2 of the aperture portion fluorescent layer 5 is set as the optimal film thickness for obtaining the function as a diffusion sheet.

A description is subsequently given of the production steps of forming the fluorescent layer 3 and the aperture portion fluorescent layer 5 having different film thicknesses on the inner surface of the tubular bulb 2. When the film thickness required for the fluorescent layer 3 is t1 and the film thickness required for the aperture portion fluorescent layer 5 is t2, a fluorescent layer having a film thickness of (t1–t2) is formed on the entire inner surface of the tubular bulb 2 by coating with the layer, baking it and so on.

Thereafter, trimming is carried out to remove the fluorescent layer at a position corresponding to the aperture portion 4 and then a fluorescent layer having a thickness t2 required for the aperture portion fluorescent layer 5 is formed on the entire inner surface of the tubular bulb 2. Thus, the fluorescent layer 3 having a required film thickness t1 and the aperture portion fluorescent layer 5 having a required film thickness t2 can be obtained.

A description is subsequently given of the function and effect of the aperture type fluorescent lamp 1 of the present invention configured as described above. Since the aperture portion fluorescent layer 5 having a film thickness t2 for optimizing a diffusion function is formed on the aperture portion 4, when light emitted from the fluorescent layer 3 passes through the aperture portion 4 and is radiated to the outside, it is properly diffused and nonuniform illuminance is inhibited to obtain uniform illuminance.

Simultaneously, the aperture portion fluorescent layer 5 emits light with uniform illuminance due to the uniform film thickness t2. Thus, nonuniformity in the illuminance of light radiated from the aperture portion 4 is further suppressed by the light from the above aperture portion fluorescent layer 5 and the above-described diffusion function thereof. In addition, the aperture portion fluorescent layer 5 has a higher light transmission property than the fluorescent layer 3 because it is made thinner than the fluorescent layer 3. A reduction in the amount of light caused by the formation of the aperture portion fluorescent layer 5 presents no practical problem due to the high light transmission property and light emission function of the aperture portion fluorescent layer 5.

Figure 2:
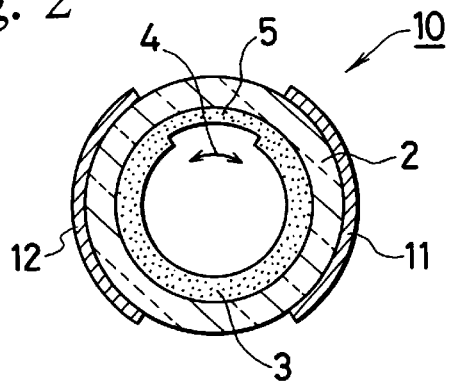
FIG. 2 is a sectional view of an aperture type fluorescent lamp according to a second embodiment of the present invention.

FIG. 2 shows a second embodiment of the present invention. This second embodiment is an aperture type fluorescent lamp 10 in which lighting is carried out by a pair of external electrodes 11, 12 provided on the outer surface of the tubular bulb 2 and facing each other.

In this case, since the external electrodes 11, 12 are formed by aluminum vapor deposition or silver conductive coating to have a reflection function, it is possible to cause light going to the outside of the bulb out of light emitted from the fluorescent layer 3 to be reflected toward the inner side and radiated from the aperture portion 4. Thus, efficiency can be improved. The structures, formation methods, functions and effects of the fluorescent layer 3 and the aperture portion fluorescent layer 5 are totally the same as those of the first embodiment except above.

Figure 3:
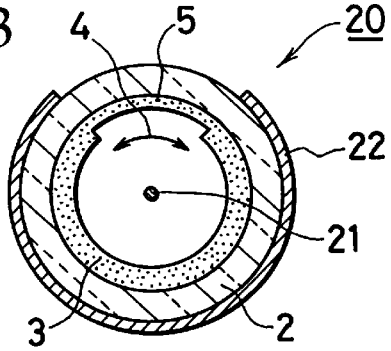
FIG. 3 is a sectional view of an aperture type fluorescent lamp according to a third embodiment of the present invention.

FIG. 3 shows a third embodiment of the present invention. This third embodiment is an aperture type fluorescent lamp 20 in which lighting is carried out by an internal electrode 21 provided at the center of the tubular bulb 2 and an external electrode 22 provided on the outer surface of the tubular bulb 2.

In this case, as the external electrode 22 has a reflection function, efficiency can be improved. Further, since an aperture portion fluorescent layer 5 is formed on the aperture portion 4, nonuniform illuminance caused by the shadow of the internal electrode 21 is inhibited by the aperture portion fluorescent layer 5 and the internal electrode 21 cannot be seen from the aperture portion 4, thereby making it possible to prevent an observer from being given a feeling of disorder. The fluorescent layer 3 and the aperture portion fluorescent layer 5 are totally the same as those of the above embodiments.

Figure 4:
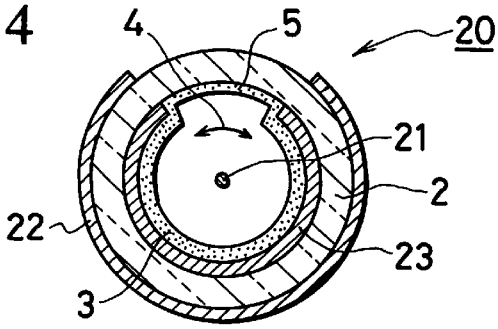
FIG. 4 is a sectional view of an aperture type fluorescent lamp according to a fourth embodiment of the present invention.
Figure 5:
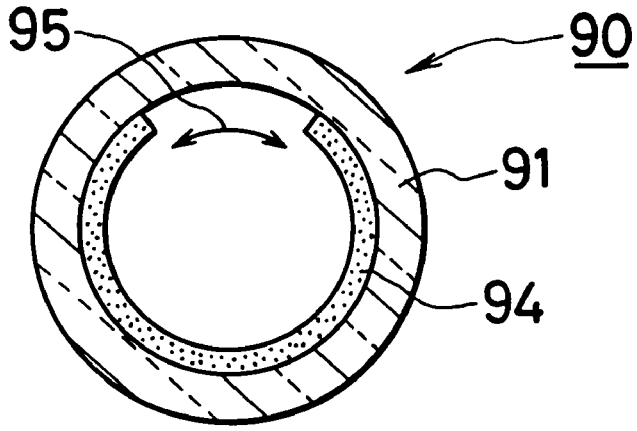
Fig. 5 Prior Art
FIG. 5 is a sectional view of an aperture type fluorescent lamp according to the prior art.
Figure 6:
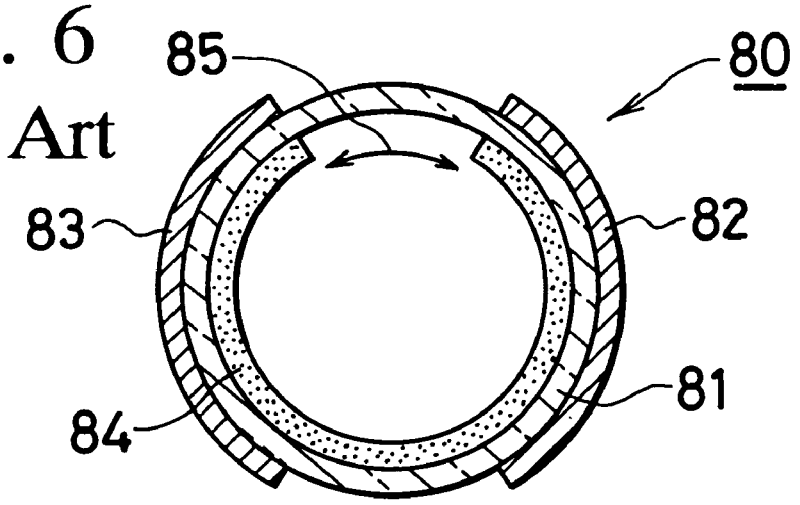
Fig. 6 Prior Art
FIG. 6 is a sectional view of another aperture type fluorescent lamp according to the prior art.
Figure 7:
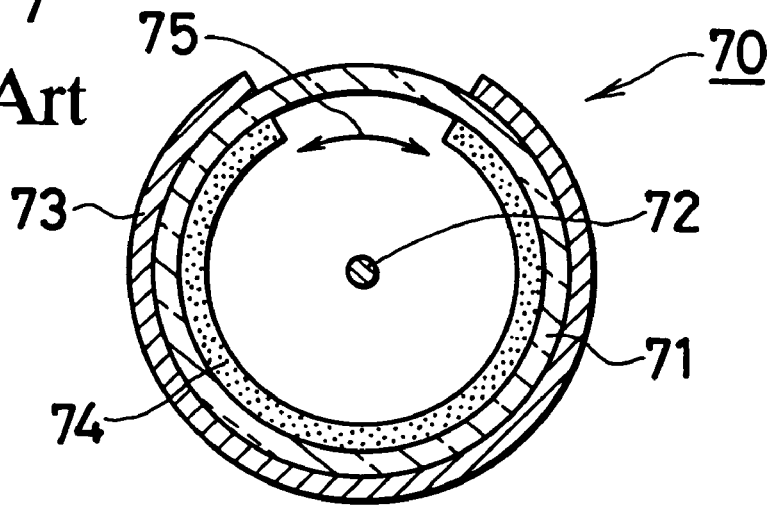
Fig. 7 Prior Art
FIG. 7 is a sectional view of still another aperture type fluorescent lamp according to the prior art.

FIG. 4 shows a fourth embodiment of the present invention. This fourth embodiment is an aperture type fluorescent lamp 20 in which lighting is carried out by an internal electrode 21 provided at the center of the tubular bulb 2 and an external electrode 22 provided on the outer surface of the tubular bulb 2 like the third embodiment.

However, in this fourth embodiment, an inner reflection layer 23 is formed from a white dielectric on the inner surface of the tubular bulb 2 excluding the aperture portion 4, a fluorescent layer 3 is formed on the inner surface of the inner reflection layer 23, and an aperture portion fluorescent layer 5 is formed on the aperture portion 4.

Also in this case, the fluorescent layer 3 and the aperture portion fluorescent layer 5 can be formed in the same manner as in the first to third embodiments and the inner reflection layer 23 is added. Therefore, the function and effect of this embodiment are totally the same as those of the third embodiment except that the external electrode 22 does not need a reflection function.

As described above, since an aperture type fluorescent lamp is configured such that an aperture portion fluorescent layer having a smaller thickness than the fluorescent layer of other portions is formed on the aperture portion, light passing through the aperture portion is diffused and light is uniformly emitted from the aperture portion by forming the aperture portion fluorescent layer on the aperture portion, thereby making it possible for the aperture portion which has had no illuminance equalizing means and let radiation passing directly in the prior art to equalize illuminance. Thus, the present invention provides such an extremely excellent effect that the performance of the aperture type fluorescent lamp is improved.

Particularly, in the aperture type fluorescent lamp comprising an internal electrode and an external electrode, it is possible to eliminate nonuniformity in illuminance caused by the shadow of the internal electrode and prevent the internal electrode from being seen through the aperture portion in order not to give an observer a feeling of disorder. Thus, the present invention provides such an excellent effect that the appearance of the fluorescent lamp is improved.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. An aperture type fluorescent lamp comprising a tubular bulb, an electrode, and a fluorescent layer formed on an inner surface of said tubular bulb in an axial direction of the tubular bulb, an aperture portion provided in said fluorescent layer along the axial direction of the tubular bulb so as to be made the aperture portion as a radiation portion, wherein said aperture portion comprises an aperture portion fluorescent layer having a thickness smaller than the fluorescent layer of other portions.

2. The aperture type fluorescent lamp according to claim 1, wherein said electrode comprises a thermo-electrode provided at both ends of said tubular bulb.

3. The aperture type fluorescent lamp according to claim 1, wherein said electrode comprises a cold cathode provided at both ends of said tubular bulb.

4. The aperture type fluorescent lamp according to claim 1, wherein said electrode comprises a pair of external electrodes provided on an outer surface of said tubular bulb and facing each other.

5. The aperture type fluorescent lamp according to claim 1, wherein said electrode comprises an internal electrode provided at the center in the axial direction of the tubular bulb and an external electrode provided on an outer surface of said tubular bulb.

* * * * *